US006607419B2

(12) United States Patent
Day et al.

(10) Patent No.: US 6,607,419 B2
(45) Date of Patent: Aug. 19, 2003

(54) INTERLOCKING BALLOONS

(75) Inventors: Maureen Day, Florissant, MO (US); Patricia Grissom, O'Fallon, MO (US)

(73) Assignee: Betallic, LLC, St. Louis, MO (US)

( * ) Notice: Subject to any disclaimer, the term of this patent is extended or adjusted under 35 U.S.C. 154(b) by 0 days.

(21) Appl. No.: 09/916,015

(22) Filed: Jul. 26, 2001

(65) Prior Publication Data

US 2003/0022591 A1 Jan. 30, 2003

(51) Int. Cl.[7] ..... H63H 3/06
(52) U.S. Cl. ..... 446/226; 446/220; 46/407
(58) Field of Search ..... 446/220, 221, 446/223, 226; 206/522, 504; 40/407, 412, 422, 439, 477; D21/436–440

(56) References Cited

U.S. PATENT DOCUMENTS

| | | | | |
|---|---|---|---|---|
| 1,549,790 A | * | 8/1925 | Neusella | 446/220 |
| 1,575,682 A | * | 3/1926 | Griffiths | 446/226 |
| 1,610,155 A | * | 12/1926 | Riley et al. | 426/220 |
| 1,659,248 A | * | 2/1928 | Eldon | 446/220 |
| 1,916,527 A | | 7/1933 | Pastir | |
| 2,008,552 A | | 7/1935 | Jacobs | |
| 2,134,063 A | | 10/1938 | Turchányi | |
| 2,838,872 A | * | 6/1958 | Beck | 446/226 |
| 2,959,888 A | * | 11/1960 | Noble | |
| 3,693,266 A | | 9/1972 | Pressman | |
| 3,994,102 A | * | 11/1976 | Johnson et al. | 446/220 |
| 4,185,819 A | * | 1/1980 | Hartley | 473/414 |
| 4,213,267 A | | 7/1980 | Curtis | |
| 4,267,662 A | * | 5/1981 | Gordy | 446/89 |
| 4,309,851 A | * | 1/1982 | Flagg | 52/2.21 |
| 4,850,926 A | | 7/1989 | Lovik | |
| 4,892,500 A | | 1/1990 | Lau | |
| 4,917,646 A | | 4/1990 | Kieves | |
| 5,127,867 A | | 7/1992 | Lau | |
| 5,169,353 A | | 12/1992 | Myers | |
| 5,273,477 A | * | 12/1993 | Adams, Jr. | 446/108 |
| 5,282,768 A | | 2/1994 | Akman | |
| 6,019,660 A | | 2/2000 | Luciano | |
| 6,146,721 A | * | 11/2000 | Freynet | 428/7 |
| 6,332,823 B1 | * | 12/2001 | Rouse, Jr. | 446/220 |

FOREIGN PATENT DOCUMENTS

| | | | | |
|---|---|---|---|---|
| GB | 2035938 A | * | 6/1980 | B64B/1/40 |

* cited by examiner

*Primary Examiner*—Derris H. Banks
*Assistant Examiner*—Bena B. Miller
(74) *Attorney, Agent, or Firm*—Thompson Coburn, LLP

(57) ABSTRACT

An inflatable article comprises a primary inflatable portion and at least one inflatable extension connected to the primary inflatable portion. The inflatable extension has a generally hook-shaped configuration adapted for interlocking engagement with a generally hook-shaped inflatable extension of another similar inflatable article in a manner to removably interlock the articles with one another when the articles are substantially inflated.

18 Claims, 2 Drawing Sheets

INTERLOCKING BALLOONS

BACKGROUND OF THE INVENTION

The present invention relates to inflatable balloons and, more particularly, to decorative novelty balloons that may be interconnected with another.

For decades, inflatable balloons have been used for decoration and ornamentation, and also for general amusement. Latex balloons and non-latex balloons, e.g., Mylar® balloons, have been formed in a variety of entertaining shapes, such as animals and characters for use as toys and decoration. Such balloons have also been formed with a variety of designs and colors to embrace various themes, including birthdays, holidays, weddings and anniversaries. When used as decoration or ornamentation, it is often desirable to connect a number of balloons together to form a chain or array of such balloons. By connecting multiple balloons together, a variety of decorative structures, such as archways, can be constructed.

In the prior art, various methods have been used to connect balloons to one another. A common method of connecting balloons has been to use an adhesive, such as adhesive tape. While adhesive tape is effective in securing adjacent balloons to one another, it is undesirable because the tape may be difficult to remove once adhered, and the use of adhesive tape tends to weaken the balloon wall in the area of connection, which may cause the balloon to burst. Another common method of connecting balloons to one another has been to use strings or clips to tie or otherwise connect a number of balloons together by their stems. However, the process of tying the strings is labor intensive and, moreover, the strings add weight to the balloons, which may be undesirable in the case of buoyant, helium-filled balloons. Still another prior art method involves balloons formed with integral tabs and slots, wherein a tab from one balloon is inserted into the slot of an adjacent balloon and then secured thereto with a hook and loop fastener or an adhesive to connect the two adjacent balloons to one another. U.S. Pat. No. 5,169,353 issued to Myers discloses such an arrangement. However, formation of the integral tabs and slots complicates the manufacturing process, and the device still requires the use of an adhesive or other fastener to secure the balloons to one another. A problem with all of these prior art methods is that, once connected, it is often difficult to disconnect the balloons from one another without causing damage to the balloons.

Thus, there is a need for an improved manner of connecting decorative novelty balloons to one another, which addresses these problems of the prior art.

SUMMARY OF THE INVENTION

A general object of the present invention to provide a quick and easy mechanism for temporarily connecting adjacent balloons to one another. A more specific object of the present invention is to provide a mechanism for connecting adjacent balloons without the need for adhesive, string, or other mechanical fasteners. Still another object of the invention is to provide a mechanism and method for connecting adjacent balloons to one another in a manner that permits them to be quickly and easily disconnected from one another, if desired, without causing damage to the balloons.

In general, an inflatable article of the present invention comprises a primary inflatable portion and at least one inflatable extension. The inflatable extension is connected to the primary inflatable portion. The inflatable extension has a generally hook-shaped configuration adapted for interlocking engagement with an inflatable, generally hook-shaped extension of another similar inflatable article in a manner to removably interlock the articles to one another when the articles are substantially inflated.

In another aspect of the present invention, an inflatable article comprises first and second sheets of flexible, substantially non-elastomeric, generally gas-impermeable material. Each of the first and second sheets has a peripheral edge portion. The first and second sheets are sealed to one another at their respective peripheral edge portions to define an inflatable volume between the first and second sheets. The first and second sheets are shaped to define a primary inflatable portion and at least one inflatable extension connected to the primary inflatable portion. The inflatable extension is adapted for interlocking engagement with an inflatable extension of another similar inflatable article in a manner to removably interlock the articles to one another when the articles are substantially inflated.

In still another aspect of the present invention, an inflatable article comprises a primary inflatable portion and at least one inflatable extension both being formed of a flexible, generally gas-impermeable material. The inflatable extension is connected to the primary inflatable portion in a manner so that an interior volume of the inflatable extension is in fluid communication with an interior volume of the primary inflatable portion. The inflatable extension exhibits resilient properties when the article is substantially inflated due to internal fluid pressure whereby temporary deformation of the inflatable extension results in a restoring force that biases the inflatable extension toward a normal, non-deformed position. The inflatable extension is adapted for resilient interlocking engagement with an inflatable extension of another similar inflatable article in a manner to removably interlock the articles to one another when the articles are substantially inflated.

In general, a method of interlocking a plurality of inflatable articles comprises the steps of: providing a plurality of inflatable articles; inflating said articles; and connecting said articles to one another. Each of the plurality of inflatable articles comprises a primary inflatable portion and at least one inflatable extension connected to the primary inflatable portion. The primary inflatable portion and inflatable extension are in fluid communication with one another. The inflatable portion of each article has a generally hook-shaped configuration. The inflatable articles are connected to one another by connecting the hook-shaped inflatable extensions to one another in a manner to removably interlock the articles with one another.

While the principal advantages and features of the present invention have been described above, a more complete and thorough understanding and appreciation of the invention may be attained by referring to the drawings and description of the preferred embodiments, which follow.

Figure 2:
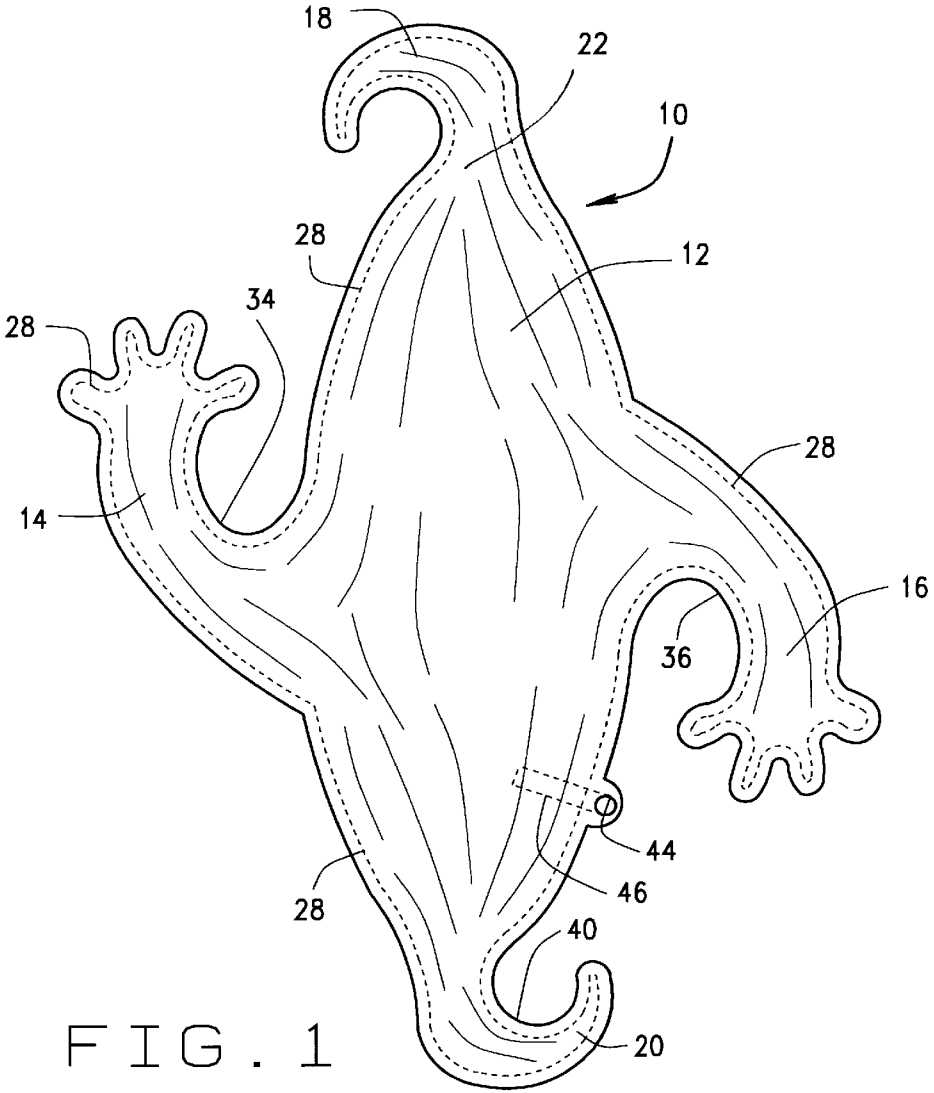
FIG. 2 is a side elevational view of the inflatable article of FIG. 1.

Reference characters in these Figures correspond to reference characters in the following detailed description of the preferred embodiments.

DETAILED DESCRIPTION OF THE PREFERRED EMBODIMENTS

Figure 1:
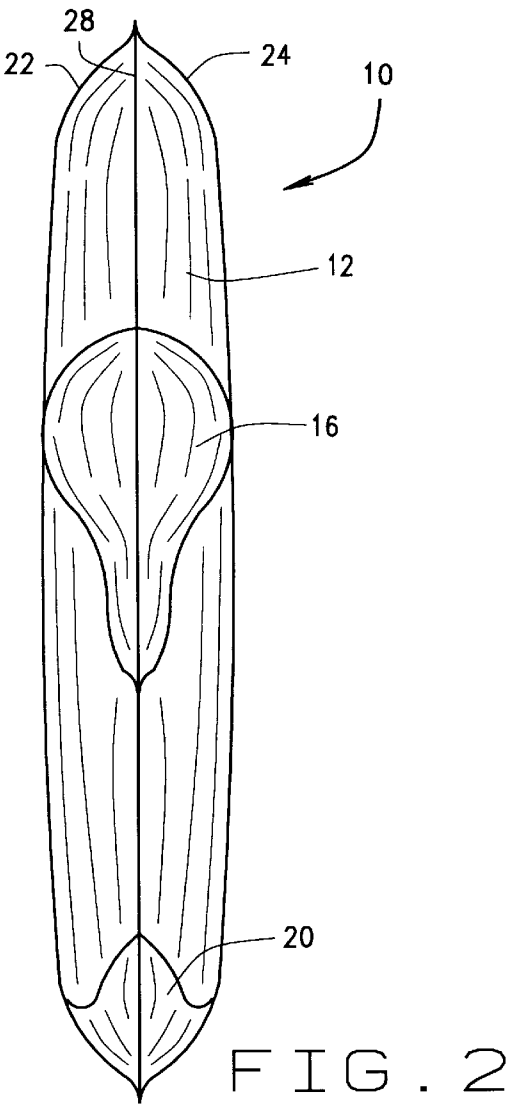
FIG. 1 is a front elevational view of an inflatable article of the present invention.
Figure 4:
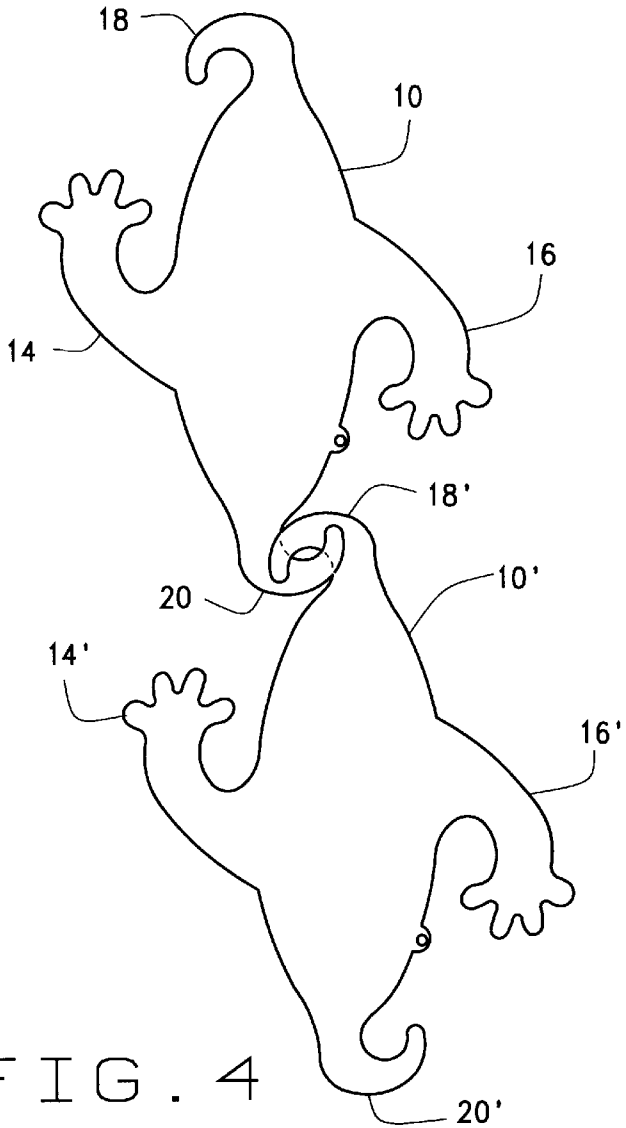
FIG. 4 is a front elevational view of a plurality of such inflatable articles interconnected with one another in a top-to-bottom fashion.
Figure 3:
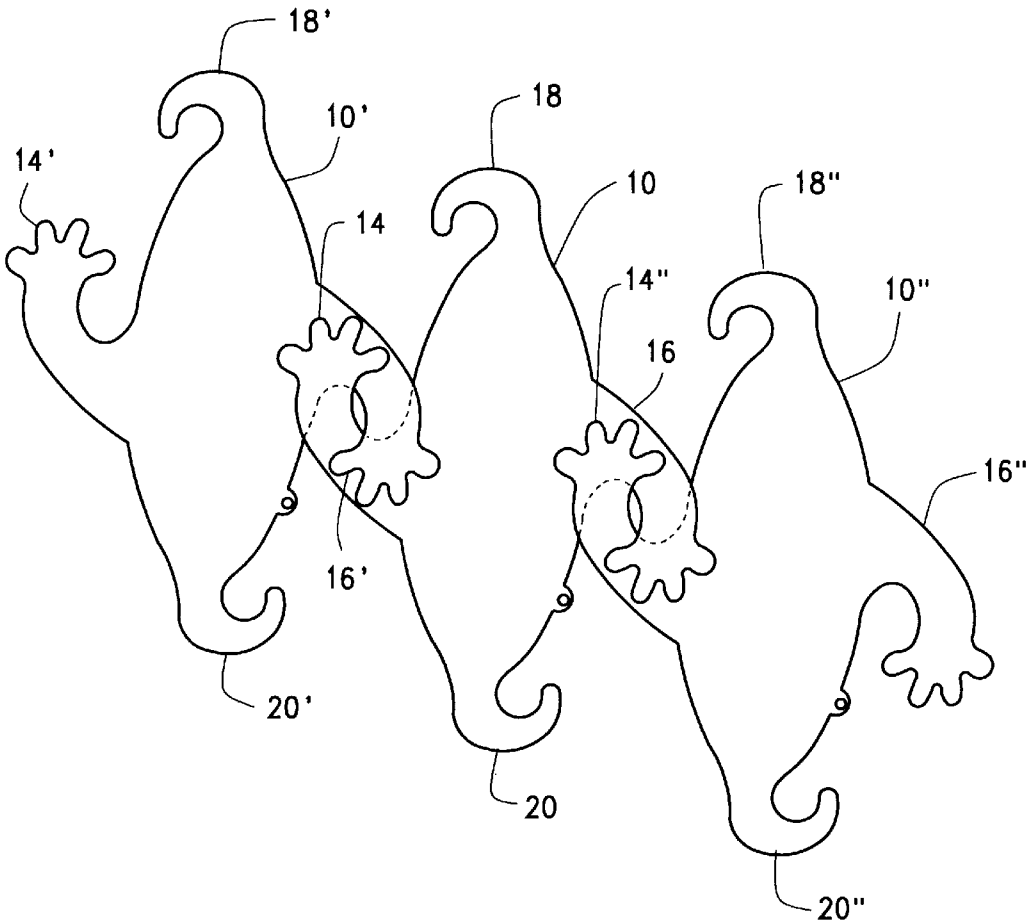
FIG. 3 is a front elevational view of a plurality of such articles interconnected with one another in a side-by-side fashion.

An inflatable article of the present invention is represented generally in FIGS. 1 and 2 by the reference numeral 10. The article 10 may be used by itself or, as shown in FIGS. 3 and 4, in conjunction with other similar or identical articles 10', 10", etc.), as explained below.

In general, each article 10 preferably comprises a primary inflatable body portion 12 and at least one inflatable extension or "arm" connected to the primary inflatable portion 12. More preferably, as shown in FIG. 1, each article 10 comprises a primary inflatable body portion 12, inflatable lateral extensions or "arms" 14 and 16 connected at the left and right sides of the primary inflatable portion 12, and inflatable longitudinal extensions 18 and 20 connected at the top and bottom of the primary inflatable portion 12. Preferably, each of the inflatable extensions 14, 16, 18 and 20 has a generally hook-shaped configuration. As shown in FIGS. 3 and 4, and as discussed below in more detail, each of the generally hook-shaped extensions 14, 16, 18 and 20 is adapted for interlocking engagement with a similar inflatable extension of another adjacent inflatable article in a manner to removably interlock the articles to one another when the articles are substantially inflated. The inflatable extensions 14, 16, 18 and 20 preferably exhibit resilient properties when the article 10 is substantially inflated due to internal fluid pressure. As explained below, the resiliency of the inflated extensions 14, 16, 18 and 20 facilitates the interlocking of adjacent inflatable articles 10, without any need for supplemental connecting components, such as adhesive tape, string or other fasteners.

Preferably, each inflatable article 10 is formed from a pair of two-dimensional flexible, generally gas-impermeable sheets 22 and 24. In the preferred embodiment, the sheets 22 and 24 are of Mylar® or another suitable flexible and generally gas-impermeable polymeric material (e.g., polyesters, polyamides, polyolefins and polyacrylates are preferred). Such polymeric sheets may or may not be decorated or "metallized" for aesthetic purposes. Alternatively, the sheets 22 and 24 could be of latex or other elastomeric or non-elastomeric materials without departing from the scope of the present invention.

The use of Mylar® in the manufacture of decorative novelty balloons is well known in the art, and the inflatable articles 10 of the present invention can be interlocking geometric shapes, etc.) without departing from the scope of the present invention.

As shown in FIG. 3, each of the inflatable lateral extensions 14 and 16 of the inflatable article 10 is adapted for interlocking engagement with a similar inflatable lateral extension of an adjacent inflatable article 10' or 10", whereby an interconnected horizontal chain of said articles can be formed. Similarly, as shown in FIG. 4, each of the inflatable longitudinal extensions 18 and 20 of each inflatable article 10 is adapted for interlocking engagement with a similar inflatable longitudinal extension of an adjacent inflatable article 10', whereby an interconnected vertical chain of said articles can be formed. In still another arrangement (not shown in the Figures), a plurality of such inflatable articles 10 is arranged in a two-dimensional array or "net" with the inflatable lateral extensions 14 and 16 of adjacent inflatable articles interlocked with one another and the inflatable longitudinal extensions 18 and 20 of adjacent inflatable articles interlocked with one another.

To this point, the connection of adjacent articles 10, 10', 10", etc., has been described only in terms of a side-by-side connection of inflatable lateral extensions 14 and 16 or a top-to-bottom connection of inflatable longitudinal extensions 18 and 20. This manner of connection of the articles 10 is preferred, especially where the article is shaped or decorated in a manner where an upright orientation matters (e.g., where the article 10 includes indicia, is shaped to represent an animal, etc.). However, alternatively, the inflatable lateral extensions 14 and 16 of one article 10 could be connected to the inflatable longitudinal extensions 18 and 20 of an adjacent article 10, which may result in an array of such articles in various orientations.

As shown in FIGS. 3 and 4, the overall shape of each of the inflatable articles 10 is preferably substantially the same, whereby such articles can be mass produced with efficiency. However, inflatable articles 10 formed in accordance with the present invention can be formed in a variety of shapes and designs, which may be used interchangeably with one another without departing from the scope of the invention.

In the preferred embodiment shown in FIGS. 1 and 2, the inflatable lateral extension 14 of each article 10 curves in a generally upward direction relative to the primary inflatable portion 12 and the inflatable lateral extension 16 curves in an opposite, generally downward direction relative to the primary inflatable portion 12. Similarly, in the preferred embodiment, the inflatable longitudinal extension 18 of each article 10 curves in a first direction (generally to the left in FIG. 1) relative to the primary inflatable portion 12 and the inflatable longitudinal extension 20 curves in an opposite second direction (generally to the right in FIG. 1) relative to the primary inflatable portion 12. However, other configurations could be made without departing from the scope of the present invention.

The generally hook-shaped configuration of the inflatable lateral extension 14 of each article 11 preferably defines a recess 34 between the inflatable extension 14 and the primary inflatable portion 12. The recess 34 is adapted to receive a portion of an inflatable extension of another of said inflatable articles (as shown in FIG. 3) in a manner to removably interlock the articles to one another when the articles are substantially inflated. Similarly, generally the hook-shaped configuration of the inflatable lateral extension 16 of each article 10 preferably defines a recess 36 between the inflatable extension 16 and the primary inflatable portion 12. Similar recesses 38 and 40 are also defined by the inflatable longitudinal extensions 18 and 20, respectively. As shown in FIG. 1, the generally hook-shaped configuration of each of the inflatable extensions 14, 16, 18 and 20 defines a generally concave interior surface of the inflatable extension. When two articles 10 are interconnected with one another (as shown in FIGS. 3 and 4), the respective concave interior surfaces of the interlocked extensions engage with one another.

The inflatable extensions 14, 16, 18 and 20 preferably exhibit resilient properties when the article 10 is substantially inflated due to internal fluid pressure. Again, interiors of the inflatable extensions 14, 16, 18 and 20 are preferably in fluid communication with the interior of the primary inflatable portion. Thus, when the article 10 is substantially inflated (e.g., between about 0.5 psi to about 1.5 psi), temporary displacement or other deformation of one of the inflatable extensions that results in a decreased interior volume of the deformed extension necessarily results in an increased internal fluid pressure in the article 10, especially when the sheets 22 and 24 are of substantially non-elastomeric materials, such as Mylar®. This temporary increase in internal fluid pressure in turn causes a restoring force that tends to bias the deformed extension back toward its normal, non-deformed position. The resiliency of the extensions 14, 16, 18 and 20 permits the extensions of adjacent articles to be connected with one another in a resilient interlocking engagement in a manner to removably interlock the articles to one another when the articles are substantially inflated.

The ideal internal pressure will depend on the dimensions of the article and the materials from which it is fabricated. But in any case, the articles 10 are preferably inflated to an internal pressure sufficient to provide enough resiliency in the extensions 14, 16, 18 or 20 to maintain the interlocked engagement of the extensions of adjacent articles 10 without the need for any supplemental connecting devices, such as adhesive tape or string.

Preferably, each article 10 includes an inflation port 44 with an inflation valve 46 (shown in dashed lines) to permits inflation of the article 10. In the preferred embodiment, the valve 46 is of the self-sealing type disclosed in U.S. Pat. No. 4,917,646, which is designed for use in non-latex balloons. In general, the valve 46 is made from two flexible plastic sheets, bonded together to define a valve inlet, a valve outlet and a valve passageway between the inlet and outlet. Preferably, the valve 46 is fitted entirely within the article 10 during manufacture in a manner similar to the way is such valves are fitted within non-latex balloons. During manufacture, the valve 46 is secured to an interior surface of one of the sheets 22 and 24 at the periphery thereof so that the inlet and outlet of the valve 46 lie on opposite sides of the seal line 28. The sheets 22 and 24 are then sealed to one another and to the valve 46 along the seal line 28 to integrally fuse the two flexible plastic sheets of valve 46 to the sheets 22 and 24, respectively, of the article 10. Of course, other varieties of valves could be used in lieu of the self-sealing type disclosed above. For example, clips or other devices for crimping or closing the inflation port 44, tightly tied strings, seals, or other commonly available valves could be used without departing from the scope of the present invention.

Thus, in use, a method of interlocking a plurality of inflatable articles 10 to one another comprising the steps of: providing a plurality of inflatable articles 10, substantially as described above; inflating each of said articles 10; and connecting the hook-shaped inflatable extension 14, 16, 18 or 20 of one of said articles 10 with the hook-shaped inflatable extension 14, 16, 18 or 20 of another of said articles 10 in a manner to removably interlock two or more of said articles to one another.

While the present invention has been described by reference to specific embodiments and specific uses, it should be understood that other configurations could be constructed and other uses could be made without departing from the scope of the invention as set forth in the following claims.

What is claimed is:

1. A plurality of inflatable articles comprising:

a first inflatable article having a primary inflatable portion and at least one inflatable extension connected to the primary inflatable portion: the inflatable extension of said first inflatable article having a generally hook-shaped portion that terminates at a distal end to define an open recess between the distal end and the primary inflatable portion; and a second inflatable article having a primary inflatable portion and at least one inflatable extension connected to the primary inflatable portion, the inflatable extension of said second inflatable article having a generally hook-shaped portion that terminates at a distal end to define an open recess between the distal end and the primary inflatable portion;

wherein the hook-shaped portion of the first inflatable article is shaped to interlock with the hook-shaped portion of the inflatable extension of the second inflatable article, and wherein the inflatable extension of each of said first and second inflatable articles is flexible and resilient when substantially inflated due to internal fluid pressure such that the respective hook-shaped portions of said first and second inflatable articles are resiliently and removably interlockable with one another when the articles are substantially inflated.

2. The inflatable articles of claim 1 wherein interiors of the primary inflatable portion and the at least one inflatable extension of each of the first and second inflatable articles are in fluid communication with one another to define an inflatable volume.

3. The inflatable articles of claim 1 wherein the open recess between the distal end of the hook-shaped portion and the primary inflatable portion of each article is sized to receive the similarly hook-shaped portion of the inflatable extension of another of said inflatable articles in a resilient interlocking engagement when the articles are substantially inflated.

4. The inflatable articles of claim 1 wherein each of said inflatable articles includes two generally hook-shaped inflatable extensions connected to generally opposite sides of the primary inflatable portion, each of said inflatable extensions being adapted for interlocking engagement with one of the generally hook-shaped inflatable extensions of another of said inflatable articles, whereby an interconnected chain of said articles can be formed.

5. The inflatable articles of claim 1 wherein each of said inflatable articles includes first and second generally hook-shaped inflatable extensions connected to generally opposite sides of the primary inflatable portion, the first extension curving in a first direction relative to the primary inflatable portion and the second extension curving in an opposite second direction relative to the primary inflatable portion.

6. The inflatable articles of claim 1 wherein the overall shape of each of said inflatable articles is substantially the same.

7. The inflatable articles of claim 1 wherein the primary inflatable portion and inflatable extension of each of said articles is comprised of a pair of generally coextensive, substantially non-elastomeric, generally gas-impermeable sheets sealed to one another along peripheral portions thereof to define a single inflatable volume between said sheets.

8. The inflatable articles of claim 7 wherein the sheets of each of said articles are of a metallized polymeric material.

9. A plurality of inflatable articles comprising:

first and second inflatable articles, each having first and second sheets of flexible, substantially non-elastomeric, generally gas-impermeable material, each of the first and second sheets having a peripheral edge portion, the first and second sheets of each of said inflatable articles being sealed to one another at their respective peripheral edge portions to define an inflatable volume between the first and second sheets, the first and second sheets of each of said inflatable articles being shaped to define a primary inflatable portion and at least one inflatable extension connected to the primary inflatable portion, the inflatable extension of each of said articles having a generally hook-shaped portion that terminates at a distal end to define an open recess between the distal end and the primary inflatable portion, the hook-shaped portion being shaped to interlock with a similarly hook-shaped portion of an inflatable extension of another of said inflatable articles in a manner to removably interlock the articles to one another when the articles are substantially inflated.

10. The inflatable articles of claim 9 wherein the generally hook-shaped portion of the inflatable extension of each of said articles includes a generally concave interior surface between the distal end of the hook-shaped portion and the primary inflatable portion that resiliently engages with a similarly concave interior surface of the inflatable extension of another of said inflatable articles in a manner to removably interlock the articles to one another when the articles are substantially inflated.

11. The inflatable articles of claim 9 wherein the overall shape of each of said inflatable articles is substantially the same.

12. The inflatable articles of claim 9 wherein interiors of the primary inflatable portion and the inflatable extension of each of said articles are in fluid communication with one another to define the inflatable volume.

13. The inflatable articles of claim 9 wherein the first and second sheets of each of said articles are of a metallized polymeric material.

14. A plurality of inflatable articles, each of the articles comprising a primary inflatable portion formed of a flexible, generally gas-impermeable material; and at least one inflatable extension formed of a flexible, generally gas-impermeable material, the inflatable extension being connected to the primary inflatable portion in a manner so that an interior volume of the inflatable extension is in fluid communication with an interior volume of the primary inflatable portion, the inflatable extension exhibiting resilient properties when the article is substantially inflated due to internal fluid pressure whereby temporary deformation of the inflatable extension results in a restoring force that biases the inflatable extension toward a normal, non-deformed position;

the inflatable extension of each of said articles having a generally hook-shaped portion that terminates at a distal end to define an open recess between the distal end and the primary inflatable portion, the hook-shaped portion being shaped to resiliently interlock with a similarly hook-shaped portion of an inflatable extension of another of said inflatable articles in a manner to removably interlock the articles to one another when the articles are substantially inflated.

15. The inflatable articles of claim 14 wherein the overall shape of each of said inflatable articles is substantially the same.

16. The inflatable articles of claim 14 wherein the primary inflatable portion and the at least one inflatable extension of each of said inflatable article are of a metallized polymeric material.

17. A method of interlocking a plurality of inflatable articles comprising the steps of:

providing a plurality of inflatable articles, each of said articles comprising a primary inflatable portion and at least one inflatable extension connected to and in fluid communication with the primary inflatable portion, wherein the inflatable extension of each articles has a generally hook-shaped portion that terminates at a distal end to define an open recess between the distal end and the primary inflatable portion;

inflating said articles; and connecting the inflatable extensions of adjacent articles to one another by bringing the hook-shaped portion of the inflatable extension of one of said articles into resilient engagement with the similarly hook-shaped portion of the inflatable extension of another of said articles in a manner to removably interlock the articles to one another whereby the open recess between the distal end and the primary inflatable portion of each said articles receives at least a part of the hook-shaped portion of the inflatable extension of the other of said articles.

18. The method of claim 17 wherein the step of providing a plurality of inflatable articles includes providing such articles with at least two inflatable extensions connected to and in fluid communication with the primary inflatable portion; wherein the method further comprises the step of arranging said plurality of inflatable articles side-by-side in a single-file line; and wherein the step of connecting the hook-shaped inflatable extensions of said articles to one another is performed with each pair of adjacent inflatable articles, whereby an interconnected chain of said articles is formed.

* * * * *

UNITED STATES PATENT AND TRADEMARK OFFICE

CERTIFICATE OF CORRECTION

PATENT NO. : 6,607,419 B2
DATED : August 19, 2003
INVENTOR(S) : Day et al.

It is certified that error appears in the above-identified patent and that said Letters Patent is hereby corrected as shown below:

Column 5,
Line 63, should read -- primary inflatable portion, the inflatable extension of --

Column 8,
Line 21, should read -- wherein the inflatable extension of said article has a --

Signed and Sealed this

Thirtieth Day of March, 2004

JON W. DUDAS
*Acting Director of the United States Patent and Trademark Office*